United States Patent [19]

Kilday, Sr.

[11] 4,445,497

[45] May 1, 1984

[54] FIREPLACE HEATING UNIT

[76] Inventor: Glen W. Kilday, Sr., 448 Sunset Dr., SW., Winston-Salem, N.C. 27103

[21] Appl. No.: 313,979

[22] Filed: Oct. 22, 1981

[51] Int. Cl.[3] ..... F24B 7/00

[52] U.S. Cl. ..... 126/121; 126/131; 126/152 B; 126/164

[58] Field of Search ..... 126/121, 120, 152 R, 126/152 B, 164, 131; 237/51

[56] References Cited

U.S. PATENT DOCUMENTS

| | | | |
|---|---|---|---|
| 4,170,218 | 10/1979 | Hartley | 126/121 |
| 4,174,701 | 10/1979 | Gneiting | 126/121 |
| 4,224,921 | 9/1980 | Petrescue | 126/121 |
| 4,252,106 | 2/1981 | Estes | 126/121 X |
| 4,257,390 | 3/1981 | Synan | 126/121 |
| 4,258,879 | 3/1981 | Nischwitz | 126/121 X |

*Primary Examiner*—Larry Jones
*Attorney, Agent, or Firm*—Harvey B. Jacobson

[57] ABSTRACT

A fireplace heating unit apparatus for insertion into a fireplace and hearth arrangement having two parallel heat exchange units forming a fireplace grate with each unit including a series of hollow tubing heat exchange members having a plurality of zigzag air passages therein, an air intake and a blower arrangement for directing heating air through both of the units, and in which the air intake receives air from an air space substantially vertically beneath the fireplace and hearth location. Also provided is an air gap or auxiliary air intake located proximate the blower for admitting air to be heated from the air space proximate the fireplace and hearth and for mixing this air with the air drawn from the lower air space.

6 Claims, 4 Drawing Figures

FIREPLACE HEATING UNIT

BACKGROUND OF THE INVENTION

The present invention relates to a fireplace heating unit and more particularly, the invention is directed to a pair or series of isolated and parallel, spatially connected hollow tubing structures having heat exchange air paths with at least three or more zigzag direction reversal paths and in which a single blower supplies air to both tubing structures from a lower air space or outside air which may be mixed with air from the air space surrounding the fireplace with heated air being discharged through two separate outlets in the space being heated.

FIELD OF THE INVENTION

Considerable research and development on fireplace energy saving apparatus indicates need for improved wood burning fireplace heating units.

There has always been a need for supplying additional volume of heated air than for providing for heat itself, since the provision of heated air at temperatures ranging from 200°-250° F. and above is not necessarily useful for heating homes. Many single unit air heating devices with blower arrangements have been inadequate for effective home heating.

The fireplace heating unit for burning wood fuel of the present invention provides for unheated air being supplied partially from an air space substantially beneath the fireplace and hearth area and partially from the space being heated, passing the mixed air through a plurality of zigzag heat exchange areas within the fireplace and hearth area and discharging heated air directly to the air space adjacent the fireplace and hearth with an improved heat-to-air volume ratio.

DESCRIPTION OF PRIOR ART

Devices are known which use a blower arrangement in combination with a hollow grate and in which outside air is supplied to a grate as shown in certain of the following U.S. patents:

U.S. Pat. No. 4,010,729—Mar. 8, 1977—Egli;
U.S. Pat. No. 4,062,345—Dec. 13, 1977—Whiteley;
U.S. Pat. No. 4,161,168—July 17, 1979—Cagle;
U.S. Pat. No. 4,183,347—Jan. 15, 1980—Newswanger;
U.S. Pat. No. 4,256,084—Mar. 17, 1981—Engleman;
U.S. Pat. No. 4,258,879—Mar. 31, 1981—Nischwitz;
U.S. Pat. No. 4,271,814—June 9, 1981—Lister.

None of these patents suggest or disclose hollow grate constructions for directing forced air from a lower air space through a series of zigzag paths connected in parallel arrangement and then directed centrally into an air space to be heated in the manner of the present invention. Thus, none of these patents, whether taken and viewed singly or in combination, are believed to have a bearing on the patentability of any claim of this invention.

SUMMARY OF THE INVENTION

An object of the present invention is to provide a heating unit insertable into a fireplace which uses air from a basement, outside air or other air space in a home with a blower mixing the air and forcing it through a hollow grate having plural and isolated zigzag flow paths and then discharging the heated air into the air space to be heated.

Another object of the present invention is to provide a heating unit that tends to provide low ash accumulation, low fuel consumption, adequate hot air volume to heat the space being heated to an adequate temperature, retaining a comfortable humidity level in the heated air by using more humid air from a lower air space such as a basement or from an outside source.

A further advantage and object of the invention is to provide a heating unit in accordance with the preceding objects in which a blower assembly that forces the air through the grate includes an air gap construction for receiving air surrounding the blower assembly that may be mixed with air drawn from beneath the heated air space. Experience has shown that this source of air through the air gap automatically controls the amount of cold air entering the heated air space in almost direct proportion to air draft up the chimmey.

Still another object and advantage of the present invention is to provide heated air plus humid air to the hollow metal grate for improved heat and humidity characteristics of the resulting heated air.

A still further object of the invention is that instead of the usual cold air movement toward the fireplace, there is provided forced hot air and convectional air movement away from the fireplace to other rooms of the house and heated air space so that maximum and efficient air heating is thereby achieved.

Yet another object of this invention is to provide a forced air heating unit forming a log supporting grate inserted into a fireplace with the grate including two side-by-side isolated heat exchange assemblies each of which includes a plurality of spaced, parallel tubes extending from front to rear of the fireplace with the tubes being connected to define two independent zigzag air flow paths with both of the flow paths receiving air from a single blower and each flow path including a discharge directed outwardly of the fireplace.

Another significant object of the present invention is to provide a zigzag air space in parallel arrangement and having essentially square or rectangular cross sections such that air is directed from a lower and humidified air space directed through a blower and the hollow members comprising a fireplace heating unit so that the resulting heat together with radiant energy from the combustion of fuel in the fireplace is directed into the desired heated air space. Glass doors for the fireplace unit may be provided to increase the performance and appearance of the unit.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
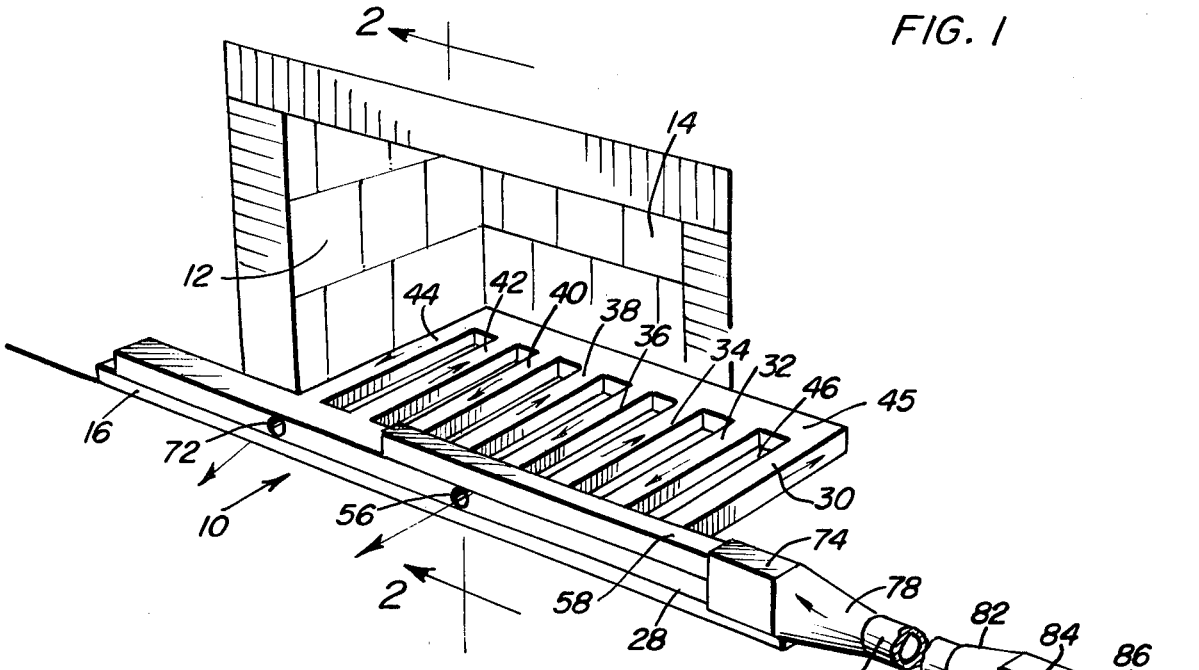
FIG. 1 is a perspective view of an improved fireplace heating unit according to a preferred embodiment and best mode of the present invention illustrating its relationship to a fireplace.

Referring now to the drawings, the fireplace heating unit of the present invention is genereally designated by reference numeral 10 and is illustrated installed in operative position in a conventional fireplace which includes side walls 12, a rear heat reflecting wall 14 and a bottom wall or hearth 16 which is oriented in coplanar relation or elevated above an adjacent floor 18 which is supported in the usual manner by supporting floor joists 22. The construction of the fireplace itself and the surrounding floor, room walls and other house structure is conventional with the heating unit 10 of the present invention capable of being constructed in various sizes depending upon the size characteristics of an existing fireplace. The heating unit 10 is placed on the hearth 16 of the fireplace and becomes a grate for logs 24 which are supported thereon and are burned thereon in a conventional manner. The heating unit 10 may be used with a fireplace having an open front or the front may be closed with transparent doors 26 of conventional construction which are associated with the fireplace opening in the usual manner. In lieu of the door 26, a fire screen (not shown) may be associated with the fireplace opening and the heating unit with either the door 26 or the fireplace screen, if used, being disposed on the upper surface of the heating unit as illustrated in FIG. 4.

Figure 3:
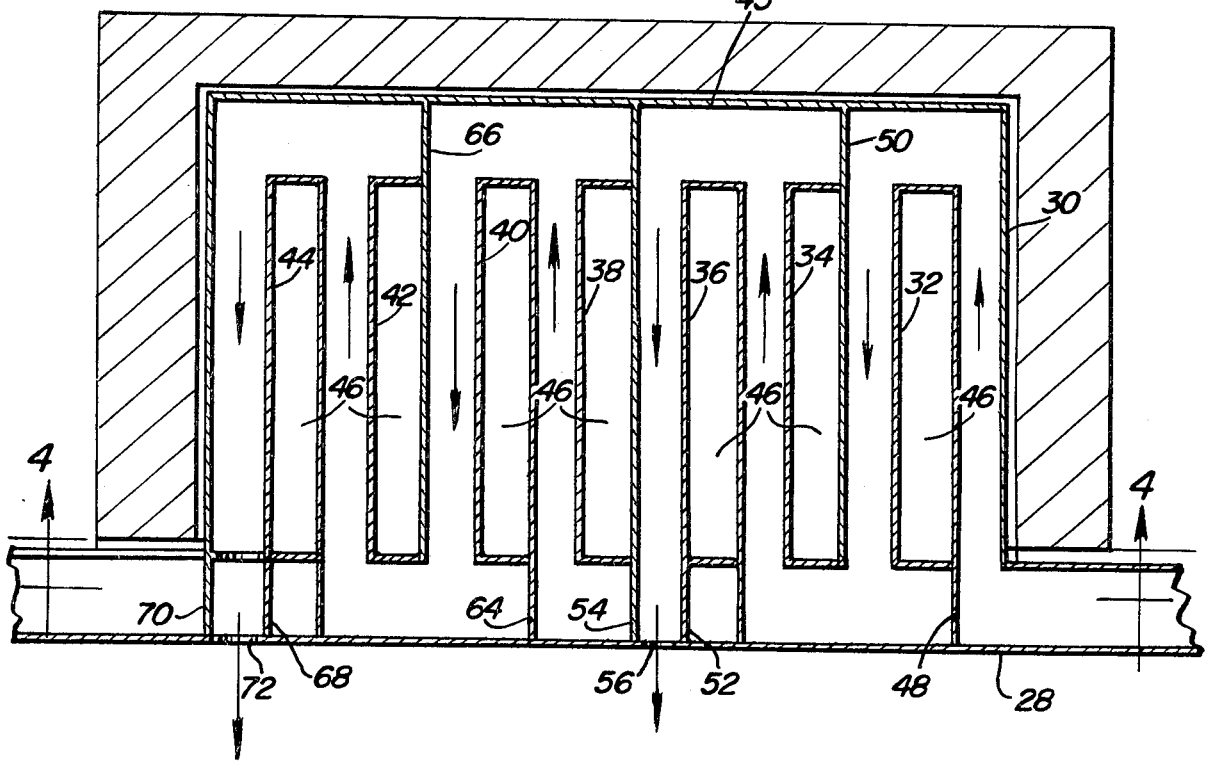
FIG. 3 is a sectional view taken along line 3—3 of FIG. 2.

The heating unit 10 includes an elongated tubular member 28 extending transversely of the fireplace at the open end thereof with the tubular member 28 resting on and supported by the hearth 16 with the ends of the tubular member extending beyond the side walls 12 of the fireplace. Rigidly connected with and communicated with the tubular member 28 is a plurality of rigid, spaced, parallel tubes 30, 32, 34, 36, 38, 40, 42 and 44 which are perpendicular to the tubular member 28 with the ends of the tubes remote from the tubular member 28 being interconnected by and communicated with a manifold 45 parallel to the tubular member 28 and located in the rear portion of the fireplace adjacent the rear wall 14 as illustrated in FIG. 3. As illustrated clearly in FIG. 1, the spaced parallel tubes provide slot-like openings or recesses 46 in the grate which provide draft supporting air to the undersurface area of the logs 24 resting on the tubes.

The tubular member 28 is rectangular and the manifold 45 is of similar configuration with the tubes 30–44 being rectangular or square in cross-sectional configuration. The upper and lower walls defining the tubular member 28, the manifold 45 and the tubes 30–44 are coplanar. The tube 30 at one end of the heating unit communicates with the tubular member 28 with a baffle 48 extending transversely of the tubular member 28 in alignment with the downstream side wall of the tube 30 thereby causing all of the air passing longitudinally inwardly of the tubular member 28 as it approaches the tube 30 to turn at right angles and pass through the tube 30. At the rear end of the tube 30, the air passes into the manifold 40 and a transverse baffle 50 is provided in the manifold 45 in alignment with the downstream wall of the tube 32 so that all of the air will then pass forwardly in tube 32 and back into the tubular member 28 on the downstream side of the baffle 48 as illustrated by the arrows in FIG. 3. A similar baffle arrangement is provided with respect to the tubes 34 and 36, except that the tube 36 includes two baffles 52 and 54 extending across the tubular member 28 with the front wall of the tubular member 28 including an opening 56 which is a discharge opening for heated air which has passed through the tubes 30–36 with this discharge opening being generally centrally located with respect to the open front of the fireplace and adjacent the floor surface.

Figure 2:
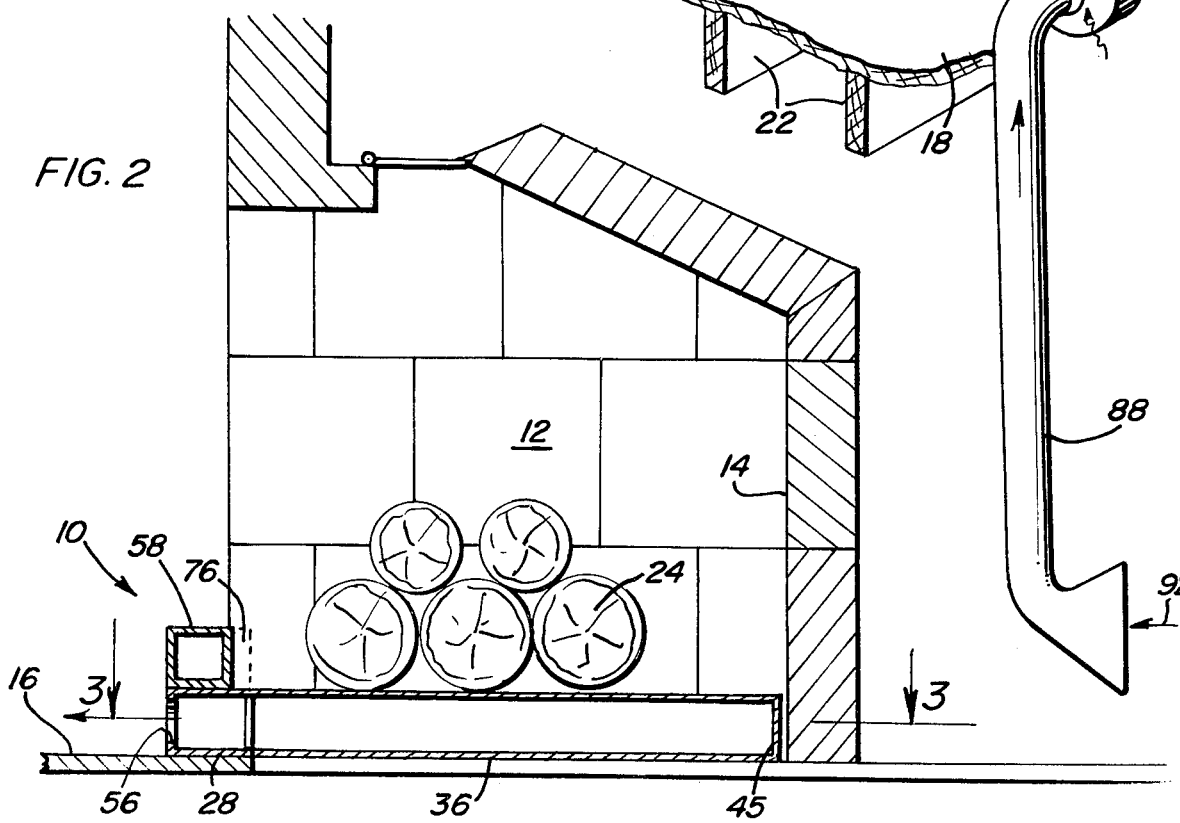
FIG. 2 is a sectional view taken along line 2—2 of FIG. 1.
Figure 4:
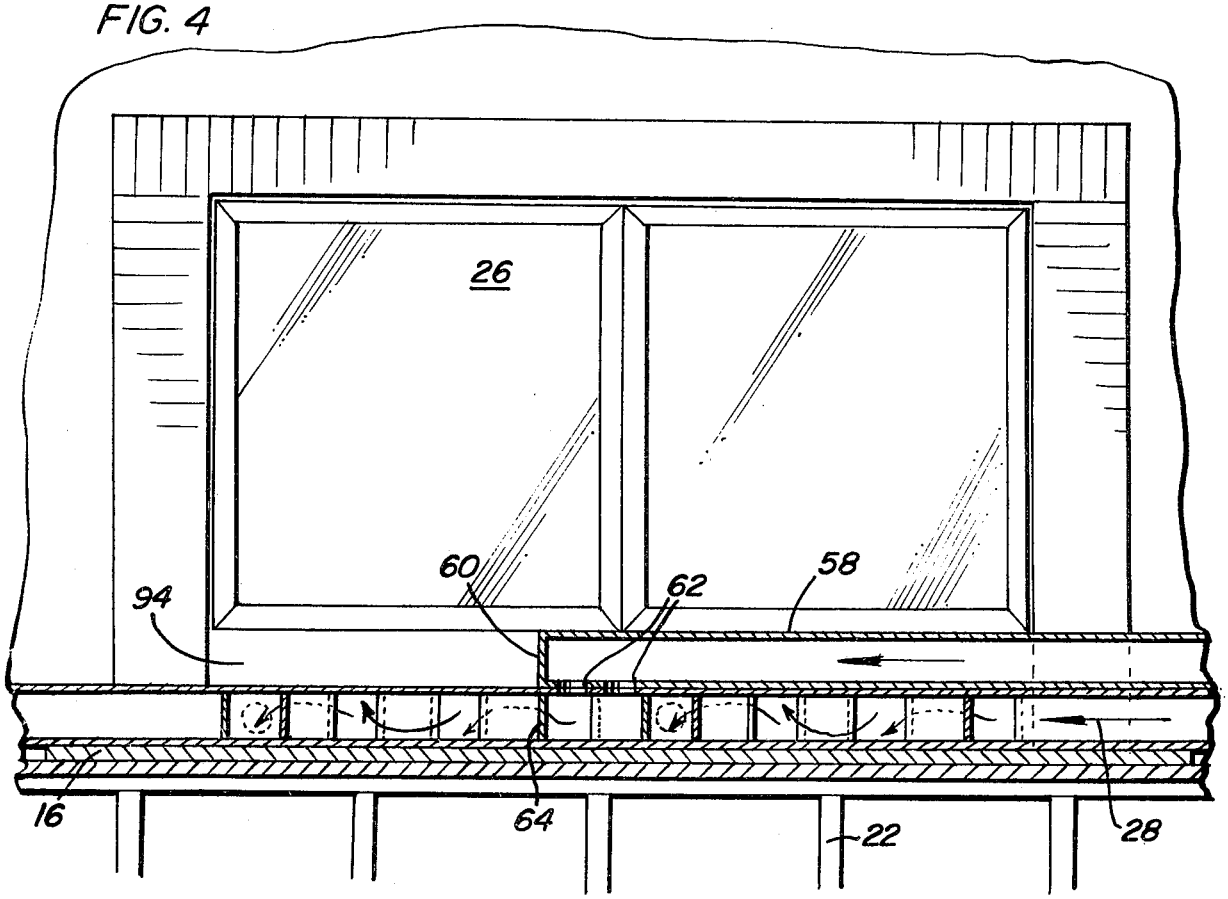
FIG. 4 is a sectional view taken along line 4—4 of FIG. 3 showing the details of the improved fireplace heating unit.

Superimposed upon the tubular member 28 is an upper tubular member 58 of less cross-sectional area and of square configuration as illustrated in FIG. 2 with the front wall of the tubular member 28 being substantially flush with the front wall of the tubular member 28 and extending for a length beyond the discharge opening 56 as illustrated in FIGS. 1 and 4. The terminal end of the tubular member 58 includes a closure plate 60 and adjacent the closure plate 60, the bottom wall of the tubular member 58 and the top wall of the tubular member 28 include a pair of adjacent but slightly spaced openings 62 so that air passing longitudinally in the tubular member 58 toward the closed end plate 60 will pass downwardly through the opening 62 in the lower tubular member 28 on the downstream side of the baffle 54 and on the upstream side of a transverse baffle 64 in alignment with the downstream side of tube 38. Thus, the air passes longitudinally of the upper tubular member 28, down through the holes 62 into the lower tubular member 28 and then rearwardly through tube 38, into the manifold 45 where it reverses direction and returns to tubular member 28 through tube 40 because of the transverse baffle 66 in the manifold 45 in alignment with the downstream side of tube 40. The air then returns to tubular member 28 and back to the rear through tubular member 42 and then forwardly through tube 44 where it is directed forwardly by a pair of baffles 68 and 70 extending transversely of the tubular member 28 with the front wall of the tubular member 28 having a discharge opening 72 therein spaced horizontally from the discharge opening 56 for discharging heated air into the room adjacent the floor 18.

With this arrangement, two separate and distinct heat exchange assemblies are incorporated into the heating unit 10 with each of the heat exchange assemblies including a separate air inlet and a separate air outlet. Inasmuch as the lower tubular member 28 which supplies the tubes 30, 32, 34 and 36 is of larger cross-sectional area than the upper tubular member 58, a slightly greater volume of air will be discharged from the centrally located discharge opening 56 than from the discharge opening 72 which is adjacent the side wall 12 of the fireplace. This enables the device to be assembled in a manner so that the discharge opening 72 will be oriented toward that side of the room having the largest space to be heated or adjacent to that side of the room having other rooms adjoining for better distribution of heated air.

The end of the tubular members 28 and 58 remote from the discharge opening 72 is connected with an adapter 74 of rectangular configuration to telescopically fit or abuttingly engage the ends of the tubular members 28 and 58 with a filler 76, illustrated in dotted line in FIG. 2, closing the open space alongside the upper tubular member 58 and above the lower tubular member 28 so that the rectangular adapter 72 will be connected thereto in substantially air-tight relation. The adapter 74 includes a transition member 78 connected with a duct 80 which may be of cylindrical construction and either rigid or flexible and of any desired length. The other end of the duct 80 is connected to a transition member or adapter 82 connected with the outlet 84 of a blower 86 which is of conventional construction and powered by the usual electric motor. The blower 86 may be located in any suitable location and supported in any suitable manner in the room area in which the fireplace heating unit is installed. For example, the blower may be supported on the floor in any suitable manner and preferably by some type of cushioning base to eliminate transfer of vibrations from the blower into the floor and joists. The blower 86 is provided with an intake duct 88 which extends through the floor 18 and is supported from the floor joist 22 in any suitable manner. The upper end of the duct 88 is spaced from the axial intake of the blower 86 to form an air gap or air inlet 90 so that room air can enter the inlet of the blower 86, but the volume of the room air entering the blower will be controlled by the area of the air gap 90. In addition to permitting inlet of room air at a predetermined volume, the separation of the duct 88 from the blower 86 will eliminate transfer of vibrations from the blower 86 into the duct 88 and subsequently into the joists or other supporting structure for the floor 18. If desired, the area of the air gap 90 may be adjusted by providing a telescopically adjusting section on the upper end of the air duct 88. The lower end of the air duct 88 is provided with an inlet 92 which may be oriented adjacent the floor surface of the basement and may also include an outside air inlet provided with a suitable damper control or the like to enable an adjustable volume of air from the basement to be drawn into the blower 86 or an adjustable quantity of outside air or both to be drawn into the blower 86 with any type of air passing through the air duct 88 being mixed with the air drawn into the blower 86 through the air gap 90 thereby enabling any desired mixture of fresh outside air, more humid basement air and recirculated room air to be drawn into the blower 86 and thus forced through the heat exchange unit 10 and discharged into the room for heating the space therein. It is also noted that the glass doors 26 as illustrated normally are provided with a bottom plate 94 usually having draft control means therein so that the bottom edges of the doors 26 if they are swinging doors will pass over the upper tubular member 58 to enable replenishing of the logs 24 in the fireplace. This also provides access to the interior of the fireplace for cleaning ashes from the fireplace and the like.

With this unit, excessive and rapid combustion of wood fuel, normally encountered in fireplaces, is controlled by virtue of the rectangular hollow lower tubular member 28 being placed flat on the hearth in a manner that limits draft air under the logs or firebase on the grate. Further, no live flame is necessary to achieve effective heat transfer from the burning wood fuel to the air passing through the heat exchange tubes thereby substantially reducing wood consumption. The slow burning fire also reduces ash production by a substantial amount and ashes should be removed from between the heat exchange tubes on a daily basis with this being accomplished by using a narrow spatula or other similar device. By constructing the hollow grate of a plurality of heat exchange tubes and by providing a dual inlet and dual outlet isolated from each other, an increased volume of air is circulated through the heat exchange assembly thereby enabling an increased volume of heated air to be discharged into the room without the discharged heating air being at an excessive temperature. The provision of the baffles or stops enables the air to make multiple passes through and under the firebase in each of the heat exchange assemblies, thereby raising the air temperature to a desired level with the increased volume of air maintaining the air temperature below an extremely high level which also reduces the temperature of the heat exchange tubes which results in prolonged life for such tubes before they become burned out due to the high temperatures encountered. By introducing cold air from outside through the vacuum side of the blower to replace air lost by chimney draft, the usual constant infiltration of cold air and movement of such cold air toward the fireplace is eliminated or reduced. Rather, warm air under slight pressure is provided in the room or rooms of a house with which the fireplace is associated. The introduction of fresh air as well as introduction of air from a basement or other remote area provides a source of moisture, thereby maintaining the humidity of the air in the rooms at a more comfortable level. The use of the glass doors 26 prevents entry of smoke or ashes into the room and inasmuch as the air exhausted through the chimmney is replaced, the glass door arrangement is optional, but a fire screen should be used in lieu of the door if it is omitted. In the event the blower fails or the source of electrical power is interrupted, an open top cylindrical pipe may be placed immediately in front of the fireplace and connected to the discharge openings 72 and 56 by suitable pipes or conduits and by opening the doors 26 partially, radiant heat from the fire in the fireplace will cause the vertical pipe to become a hot air stack thereby creating convection movement of air from the heating unit to the room area without the use of the blower.

When installed, the heating unit does not detract from the normal use and view of the fireplace and is capable of continuous use as long as the ashes are periodically removed and the fuel supply periodically renewed. By using glass closure doors for the open front of the fireplace and properly controlling combustion supporting air, the fireplace may be charged with logs at night and the supply of logs in the fireplace need not be replenished until approximately 12 hours later. Thus, considerable time is saved along with the effort and inconvenience of placing logs in the fireplace.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A fireplace heating unit comprising:

a first set of hollow tubing structures forming a first essentially zigzag heat exchange path with at least three path reversals horizontally disposed in a fireplace and having an air entry area and an air exit area, a further set of hollow tubing structures forming a second essentially zigzag heat exchange path with at least three path reversals horizontally disposed in a fireplace heating means in side-by-side relation to the first set of tubing structures and having an air entry area and an air exit area with the heat exchange paths being isolated from each other, air blower means for each set of the hollow tubing structures and coupled to each of the air entry areas thereof, said tubing structures extending from front to rear of the fireplace and supported from the hearth of the fireplace with the tubing structures being in surface contact with the hearth to form a grate to support wood logs or the like having spaces for draft air between adjacent tubing structures, said air exit areas being located at the front of the tubing structures with the air exit areas communicating with a space to be heated, the tubing structures being disposed in coplanar relation and each structure having a separate supply tube for supplying air to the air entry area thereof from the blower means, the supply tubes extending from a common adaptor attached to the blower means adjacent one side of the unit.

2. The fireplace heating unit of claim 1 wherein the hollow tubing structures are installed in a fireplace having a set of openable and transparent access means.

3. The fireplace heating unit of claim 1 wherein each of the hollow tubing structures includes a first rearwardly directed heat exchange path, a first forwardly directed heat exchange path, a second rearwardly directed heat exchange path and a second forwardly directed heat exchange path, said air entry area being disposed at the forward end of the first rearwardly directed path and said air exit area being disposed at the forward end of the second forwardly directed path.

4. The fireplace heating unit of claim 1 together with air intake means supplying air to said blower means, said blower means including a single blower discharging air to both of said air entry area through said adaptor and supply tubes, said air intake means including an intake duct extending to and receiving air from a space remote from the fireplace, and an air gap in said duct proximate the blower receiving air from the space in which the fireplace is located, the supply tube for one of the tubing structures having a portion extending over the supply tube for the other tubing structures.

5. A heating unit for insertion into a fireplace having a hearth with the heating unit resting on the hearth and forming a grate for logs or similar fuel with the grate resting directly on the hearth and with the firebase formed during combustion of the logs resting directly on the grate, said heating unit comprising a pair of heat exchange assemblies oriented in side-by-side but isolated relationship on the hearth of the fireplace, each of the heat exchange assemblies including a discharge opening directed outwardly of the fireplace with the openings being spaced horizontally from each other, each of said heat exchange assemblies receiving forced air from a blower means with the blower means located exteriorly of the fireplace and including separate tubular members supplying air to the heat exchange assemblies, each heat exchange assembly including a plurality of tubes defining a flow path for air to be heated having at least three path reversals with the tubes in each heat exchange assembly being parallel and spaced to support the logs thereon with the space between the tubes providing draft air to the logs and firebase and providing multiple passage of air in heat exchange relation to the burning logs and firebase in order to increase the volume of heated air heated by the fireplace and retaining the temperature of the discharged heated air and the heat exchange assemblies at a lower level than if a reduced volume of air passed therethrough, wherein the respective heat exchange assemblies are disposed in coplanar relation and each assembly has a separate supply tube for supplying air thereto from the blower means, the supply tubes extending from a common adaptor attached to the blower means adjacent one side of the unit.

6. The invention of claim 5 wherein the supply tube for one of the heat exchange assemblies has a portion extending over the supply tube for the other heat exchange assembly.

* * * * *